US009976341B2

(12) United States Patent
Nelson

(10) Patent No.: US 9,976,341 B2
(45) Date of Patent: May 22, 2018

(54) FIREWALL ACCESS DOOR

(71) Applicant: Paul Nelson, Pickering (CA)

(72) Inventor: Paul Nelson, Pickering (CA)

( * ) Notice: Subject to any disclaimer, the term of this patent is extended or adjusted under 35 U.S.C. 154(b) by 0 days. days.

(21) Appl. No.: 14/487,764

(22) Filed: Sep. 16, 2014

(65) Prior Publication Data

US 2017/0175436 A1 Jun. 22, 2017

(51) Int. Cl.
*E06B 5/16* (2006.01)
*A62C 2/06* (2006.01)
*E06B 3/70* (2006.01)

(52) U.S. Cl.
CPC ..... *E06B 5/164* (2013.01); *A62C 2/06* (2013.01); *E06B 3/7015* (2013.01); *E06B 2003/7028* (2013.01)

(58) Field of Classification Search
CPC ..... E06B 5/164; E06B 5/161; E06B 5/167; E06B 3/7015
USPC .... 52/784.11, 784.15, 784.16, 783.13, 784.1
See application file for complete search history.

(56) References Cited

U.S. PATENT DOCUMENTS 1,183,586 A * 5/1916 Olberg et al. ..... 52/784.11
2,614,295 A * 10/1952 Een ..... 49/399
4,282,687 A * 8/1981 Teleskivi ..... 49/503
5,355,625 A * 10/1994 Matsuoka ..... 49/400
5,735,098 A * 4/1998 Kanai et al. ..... 52/508
6,119,411 A * 9/2000 Mateu Gil et al. ..... 52/79.1
7,117,640 B2 * 10/2006 Hurzeler ..... 49/501
8,176,682 B2 * 5/2012 Gaviglia ..... 49/501
2003/0033786 A1 * 2/2003 Yulkowski ..... 52/784.15
2013/0074444 A1 * 3/2013 Baumert ..... 52/784.11
2015/0033646 A1 * 2/2015 Baumert ..... 52/232

FOREIGN PATENT DOCUMENTS

DE 102008040434 A1 * 1/2010
WO WO 2010139384 A8 * 5/2011
WO WO 2012056117 A1 * 5/2012

* cited by examiner

*Primary Examiner* — Katherine W Mitchell
*Assistant Examiner* — Marcus Menezes
(74) *Attorney, Agent, or Firm* — Elias Borges

(57) ABSTRACT

A firewall access door includes a rectangular door frame with a rectangular door coupled there to by at least one door hinge. The door consists of a first rectangular pan member and a decorative gypsum wall panel mated together. The door further includes a second rectangular pan member having a flat surface with opposite side walls extending perpendicular from a flat surface of the second rectangular pan member. The side walls of the second rectangular pan member have flanges for mounting to a back surface of the first pan member opposite the gypsum panel and adjacent the side walls of the first rectangular pan member. The second pan member spans the back of the first rectangular pan member and forms an air gap between the flat surface and the back of the rectangular pan member.

1 Claim, 4 Drawing Sheets

FIREWALL ACCESS DOOR

FIELD OF THE INVENTION

The invention relates generally to firewall access doors which are decorative, aesthetically match the surrounding wall and meet 90 minutes fire rating with a maximum 250° C. temperature rise over 30 minutes.

BACKGROUND OF THE INVENTION

One of the most critical issues for architects is to ensure that building design addresses fire-safety issues. Use of fire rated drywall constructions have increasingly become popular in modern building designs due to the flexibility they offer. The fire-resistance rating classifies the ability of an assembly to confine and isolate fire within a zone comprised of fire-resistance rated walls, ceilings and floor assemblies. The ratings relate to fire tests designed to determine how quickly fire can raise the temperature to unacceptable levels. Fire-rated assemblies are tested and certified in their entirety installed in a Firewall. Whenever an access opening through such fire rated drywall structure is desired the continuity of fire rating gets discontinued and architects/construction professionals face the challenge of providing doors that meet fire rating requirements and yet satisfy aesthetics, as much as possible.

Conventional Access doors are available in the market that are such made that do not blend with the environment and more importantly are not fire rated. There is no such door available which blends with surrounding drywall finishes to satisfy aesthetics and yet meets fire rating requirements with temperature rise criterion to ensure continuity of fire-safe constructions.

Having realized this gap in market, Nelson Industrial Inc.—the manufacturer of ACUDOR brand of access doors, dedicated itself to innovate, design and develop a new model FW-5015 Access Door. Intertek Testing Services NA Ltd., Canada have certified that FW-5015 complies with UL 10B (2009) or CAN/ULC S104 (2010) for a 90 minute rating including a maximum 250° C. temperature rise over 30 minutes.

SUMMARY OF THE INVENTION

In accordance with one aspect of the present invention, there is provided a firewall access door which is both decorative and which is highly rated against fire. The firewall access door includes a rectangular/square door frame with a rectangular/square door coupled there to by at least one door hinge, the door being dimensioned to fit within the door frame. The door consists of a rectangular/square door pan having a length and width and a mineral core fire resistant decorative gypsum wall panel. The decorative wall panel has a flat surface and four side edges and the rectangular/square door pan has a flat surface with opposite side walls extending perpendicularly from the flat surface. The rectangular/square door pan is dimensioned to receive the decorative/square gypsum panel such that the flat surface of the decorative gypsum panel is held flat against the flat surface of the door pan and the side edges of the decorative gypsum panel abut the side walls of the door pan. The door further includes a stiffener panel which consists of a rectangular/square pan having a flat surface with opposite side walls extending perpendicular from the flat surface of the stiffener panel. The side walls of the stiffener panel have flanges dimensioned to mount to the flat surface of the door pan opposite the gypsum panel and adjacent the side walls of the door pan to mount the stiffener panel to the door pan such that the flat surface of the door pan is positioned parallel to the flat surface of the stiffener panel with an air space separating the two flat surfaces. The stiffener panel has a length and width dimensioned to span the length and width of the door pan, respectively.

With the foregoing in view, and other advantages as will become apparent to those skilled in the art to which this invention relates as this specification proceeds, the invention is herein described by reference to the accompanying drawings forming a part hereof, which includes a description of the preferred typical embodiment of the principles of the present invention.

DESCRIPTION OF THE DRAWINGS

In the drawings like characters of reference indicate corresponding parts in the different figures.

DETAILED DESCRIPTION OF THE INVENTION

Figure 1:
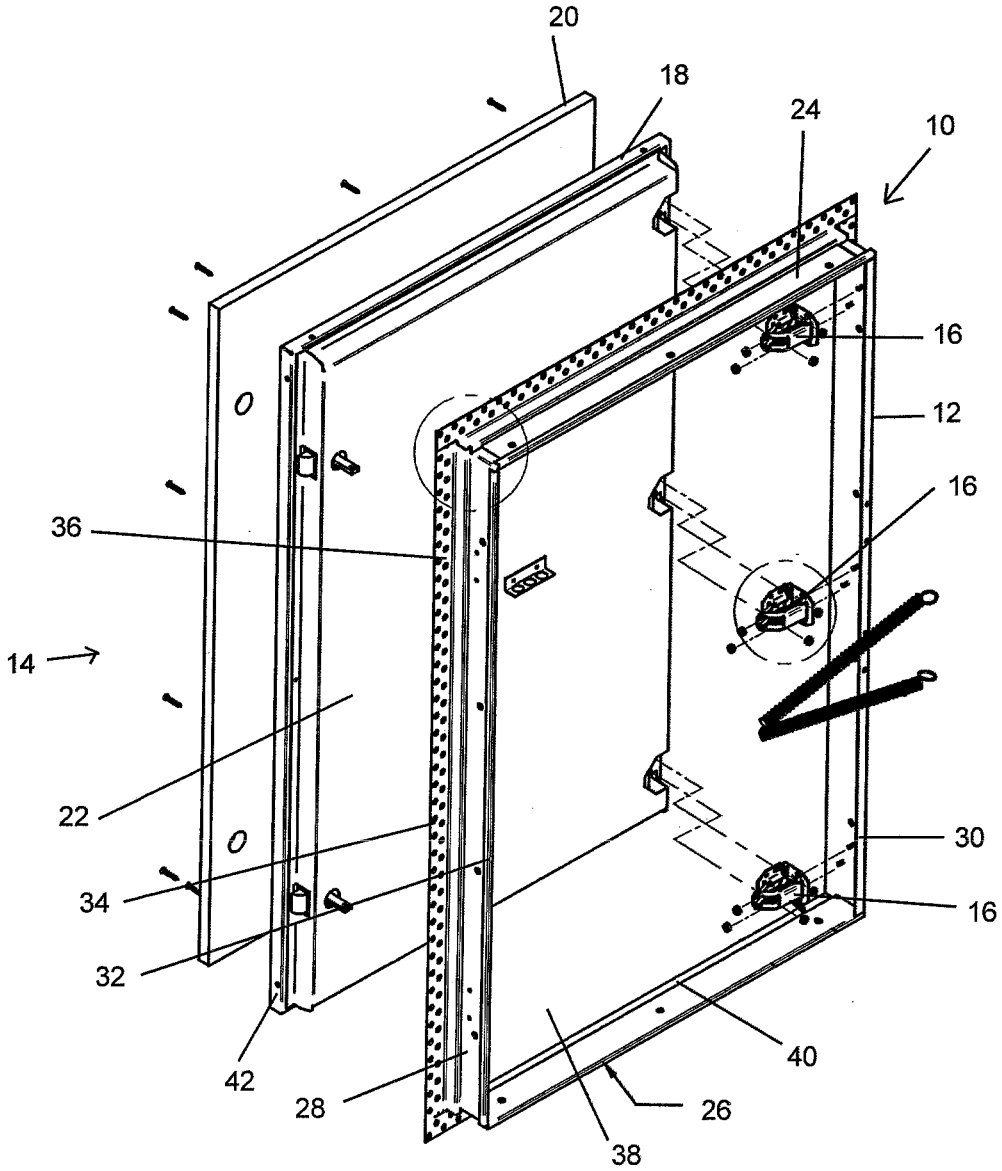
FIG. 1 is an exploded view of a fire wall access door made in accordance with the present invention.

Referring to FIG. 1, a fire wall access door made in accordance with the present invention is shown generally as item 10 and includes a frame 12 and a fire door 14 coupled to frame 12 by a plurality of hinges 16. Fire door 14 includes a rectangular door pan 18 dimensioned to snuggly receive decorative gypsum panel 20 with stiffener panel 22 mounted to the door pan opposite the gypsum panel. Door frame 12 consists of elongated frame members 24, 26, 28 and 30 which are joined together at the ends by means of spot welding or other means known generally in the art. Door frame 12 has a front portion 34 and a back portion 32. Flange 36 is formed on the front portion 34 of the door frame and extends peripherally around the outside of the door frame. Door frame 12 is mounted in the wall (not shown) with front portion 34 oriented towards the decorative outside surface of the wall. Perforated mounting flange 36 provides a means for mounting the beaded frame onto wall and enhances bonding of filler skim coat on wall in an aesthetically appealing way. Frame 12 has a large central opening 38 which is dimension to snugly receive door 14 when the door is closed.

Figure 2:
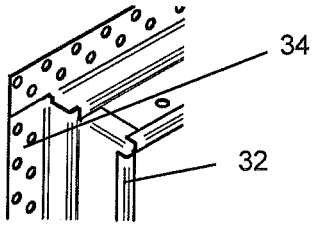
FIG. 2 is an expanded view of a portion of figure one showing a corner of the door frame.

Referring now to FIGS. 1 and 2, frame 12 has a step 40 formed between front portion 34 and back portion 32 of the frame. Step 40 forms a stop which makes contact with a peripheral edge 42 of door pan 18 when the door is closed into the door frame. Step 40 effectively divides opening 38 into a first portion between front portion 34 of the door frame and step 40 and a second portion between step 40 and back portion 32 of the door frame. The first portion of opening 38 is slightly wider and higher than the second portion of opening 38. Preferably the inside dimensions of the second portion of opening 38 are selected to snuggly receive stiffener panel 22.

Figure 3:
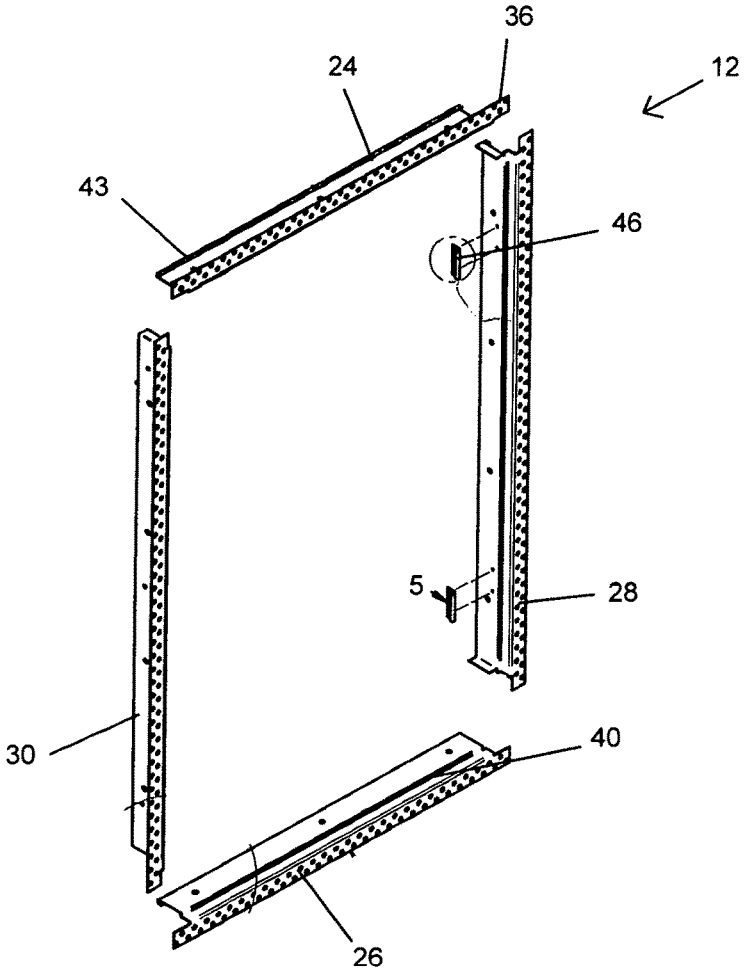
FIG. 3 is an exploded view of the door frame portion of the present invention.
Figure 5:
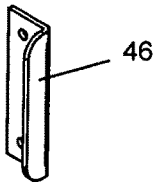
FIG. 5 is an expanded view of a portion of the door frame.
Figure 4:
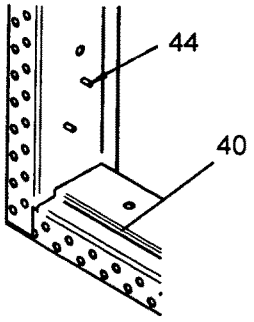
FIG. 4 is an expanded view of a corner portion of the door frame.
Figure 8:
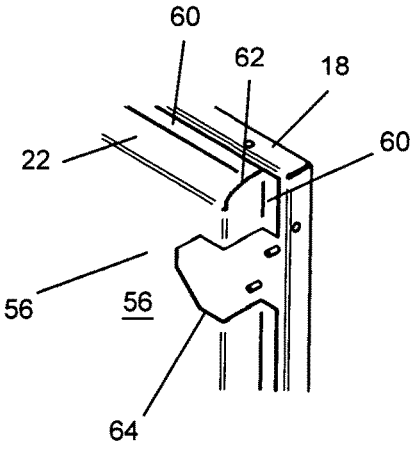
FIG. 8 is an expanded view of a corner portion of the stiffener plate attached to the door pan.

Referring now to FIGS. 3, 4 and 5, frame 12 is made up of four individual frame members 24, 26, 28 and 30 which are joined at their ends by means known generally in the art. Each frame member has a flange 36 and a body 43 perpendicular to the flange. Step 40 is formed on body 43 and extends the entire length of each frame member from end to end. Flange 36 is preferably perforated to make it easier to secure the door frame to the wall (not shown) and enhance bonding of finish skim coat of gypsum on site, then finish the door frame to make it appear seamless with the wall. The frame members are preferably made of galvanized steel which has been punched and formed into the correct shape. The inside of the assemble door frame is provided with steel studs to permit the mounting of hinges and the like. A striker plate 46 is secured to the inside surface of the finished door frame to engage the self-latching lock of self-closing door to meet fire test standards.

Figure 7:
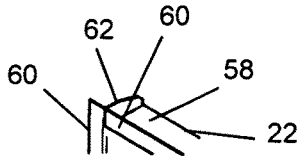
FIG. 7 is an expanded view of a corner portion of the stiffener plate.
Figure 6:
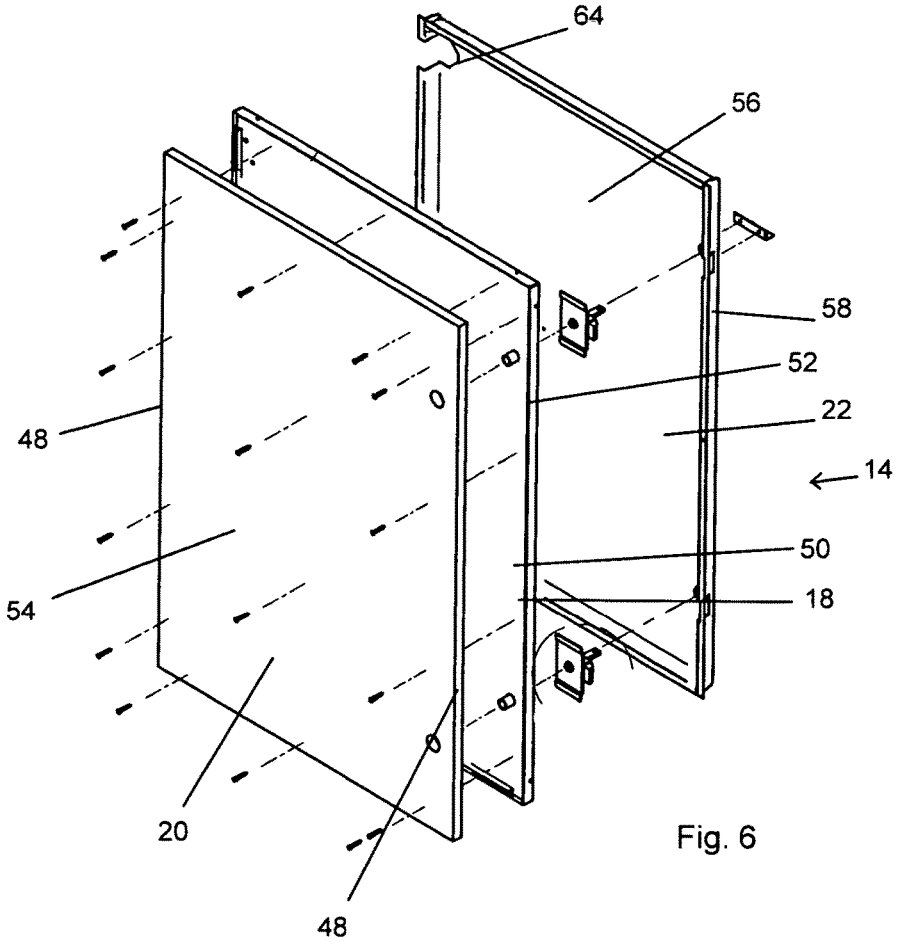
FIG. 6 is an exploded view of the door portion of the present invention.

Referring now to FIGS. 6 and 7, door 14 consists of a door pan 18 preferably formed from a sheet of steel into a flat shallow pan. Door pan 18 has a flat surface 50 with peripheral side walls 52 extending perpendicularly from the edges of flat surface 50. Specially formulated mineral core fire resistant drywall panel 20 has opposite flat surface 54 and four opposite side edges 48. Door pan 18 is dimensioned such that drywall panel 20 can be snuggly inserted into the pan with edges 48 of the drywall panel abutting side walls 52 of the door pan with one of the flat surfaces 54 of the drywall panel closely abutting flat surface 50 of the door pan. The drywall panel is oriented so that the decorative surface is facing away from the door pan.

Stiffener panel 22 is a rectangular shallow pan which is preferably formed from a formed steel sheet. Stiffener panel 22 has a flat surface 56 and side walls 58 extending perpendicularly from flat surface 56. Flanges 60 are formed on side walls 58 and extend parallel to flat surface 56. Stiffener panel 22 is dimensioned to substantially span the length and width of door pan 18. Flanges 60 are used to secure stiffener panel 22 to the back of door pan 18 by welding or by other means known generally in the art. A tapered corner element 62 is formed at each corner of the stiffener plate and extend perpendicular to flanges 60 and flat surface 56. The tapered corner element 62 tapers from flange 60 to flat surface 56, getting narrower as it approaches the flat surface. Tapered corner elements 62 ensure that the door is properly centered in the door frame when the door is fully closed. Stiffener panel is provided with cut outs 64 which permit the hinges (item 16 in FIG. 1) to be mounted directly to the back of door pan 18.

Figure 9:
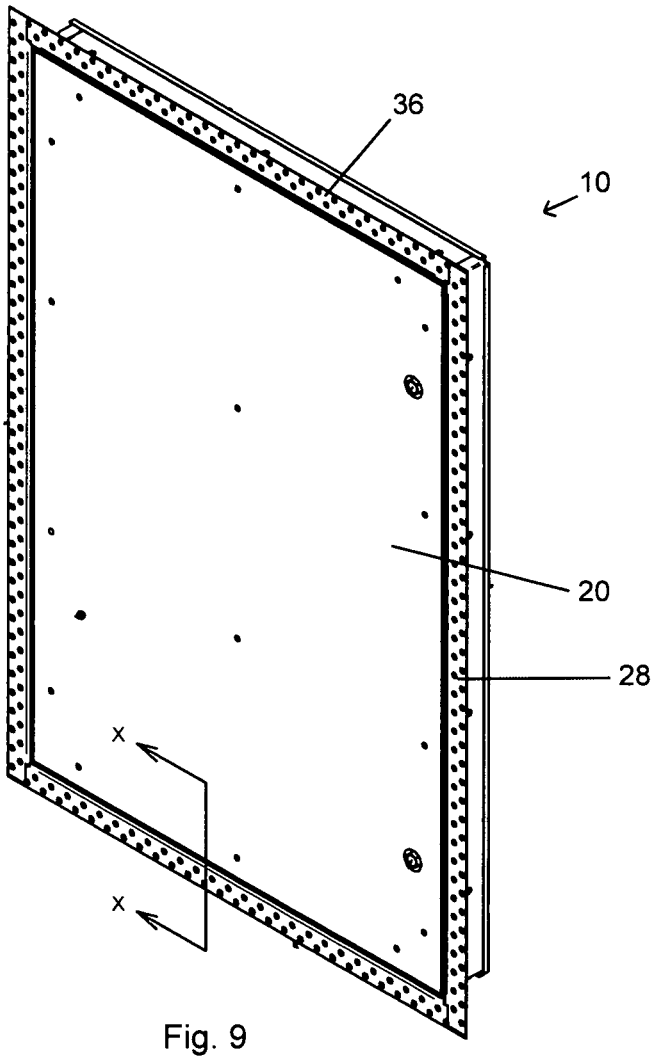
FIG. 9 is a perspective view of a fire wall access door made in accordance with the present invention with the door in a closed orientation.
Figure 10:
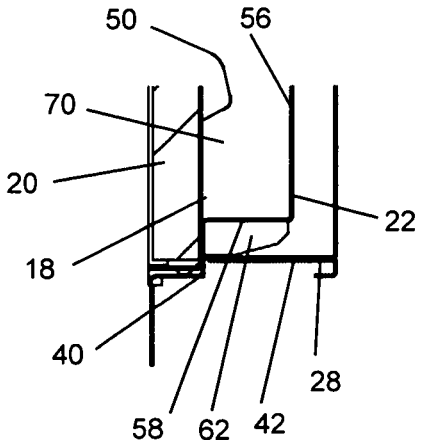
FIG. 10 is a cross sectional view taken along line X-X of FIG. 9.

Referring now to FIGS. 9 and 10, when door 10 is properly assembled, gypsum panel 20 is flush with flange 36 and the door is barely visible against the wall. Gypsum panel 20 is securely retained in door pan 18 with stiffener panel 22 mounted to the back of the door pan. Flat surface 56 of the stiffener panel is spaced apart in a parallel orientation relative to flat surface 50 of the door pan. An air gap 70 is formed between flat surface 50 of the door pan and flat surface 56 of the stiffener pan. Air gap 70 provides excellent insulation in the event of a fire, thereby greatly increasing the fire rating of the door. The combination of the specially formulated mineral core fire resistant gypsum panel with air gap formed by the stiffener panel, the fire door is certified by Intertek to comply with UL 10B (2009) or CAN/ULC S104 (2010) for a 90 minute rating including a maximum 250° C. temperature rise over 30 minutes.

Firewalls are required to remain structurally intact for a length of time when exposed to fire and should have the ability to limit the amount of heat passing through it. Whereas, Fire Barriers are non-load bearing walls, typically having lower fire-resistance ratings than Firewalls. FW-5015 with its certified parameters is suitable for installation on Firewalls. By providing additional springs to make it self-closing when horizontally installed, this same door can be made suitable for ceiling applications.

A specific embodiment of the present invention has been disclosed; however, several variations of the disclosed embodiment could be envisioned as within the scope of this invention. It is to be understood that the present invention is not limited to the embodiments described above, but encompasses any and all embodiments within the scope of the following claims.

Therefore, what is claimed is:

1. A firewall access door for a wall having a flat surface of gypsum wall panels, the firewall access door comprising:

a. a rectangular frame having opposite upper and lower frame elements, an open interior defined by the rectangular frame and a perforated mounting flange extending circumferentially around the rectangular frame, the perforated mounting flange projecting away from the open interior of the rectangular frame;

b. a rectangular door pivotally coupled to the rectangular frame, the rectangular door pivotally movable between a closed position wherein the rectangular door is within the open interior of the rectangular frame and flush with the perforated mounting flange and an open position wherein the rectangular door is at a 90° angle to the rectangular frame;

c. the firewall access door comprising a rectangular gypsum wall panel contained within a first rectangular pan member, the first rectangular pan member having a length and width and a flat portion surrounded by side walls extending perpendicularly from the flat portion, the gypsum wall panel having four side edges, a flat surface, and a second surface opposite the flat surface, the first rectangular pan member dimensioned to receive the gypsum wall panel such that the flat surface of the gypsum wall panel is held flat against the flat portion of the first rectangular pan member and the side edges of the gypsum wall panel abut the side walls of the first rectangular pan member such that the second surface of the gypsum panel is flush with the perforated mounting flange when the rectangular door is in its closed position;

d. the firewall access door further comprising a second rectangular pan member having a flat portion with opposite side walls extending perpendicular from the flat portion of the second rectangular pan member, the side walls of the second rectangular pan member having flanges dimensioned to mount to the flat portion of the first rectangular pan member opposite the gypsum panel and adjacent the side walls of the first rectangular pan member, the second rectangular pan member dimensioned such that the flat portion of the first rectangular pan member is positioned parallel to the flat portion of the second rectangular pan member with a space separating the flat portion of the first rectangular pan member from the flat portion of the second rectangular pan member, the second rectangular pan member having a length and width dimensioned to span the length and width of the first rectangular pan member, respectively, the space dimensioned to act as a thermal insulator;

e. first and second hinges for pivotally coupling the rectangular door to a side frame element of the rectangular frame, the second rectangular pan member having first and second apertures configured to receive the first and second hinges, respectively, the first and second hinges configured to mount directly to the first rectangular pan member adjacent the first and second apertures of the second rectangular pan member.

* * * * *